US006271490B1

(12) United States Patent
Miyata

(10) Patent No.: US 6,271,490 B1
(45) Date of Patent: Aug. 7, 2001

(54) WATERPROOF LEVER SWITCH

(75) Inventor: Munechika Miyata, Tokyo (JP)

(73) Assignee: Mic Enterprise Co., Ltd., Tokyo (JP)

( * ) Notice: Subject to any disclaimer, the term of this patent is extended or adjusted under 35 U.S.C. 154(b) by 0 days.

(21) Appl. No.: 09/576,964

(22) Filed: May 24, 2000

(30) Foreign Application Priority Data

May 24, 1999 (JP) ..... 11-143538

(51) Int. Cl.[7] ..... H01H 9/04; H01H 21/08

(52) U.S. Cl. ..... 200/302.1; 200/302.3; 200/335

(58) Field of Search ..... 200/4, 6 R, 6 C, 200/553, 557–559, 564, 568, 569, 302.1, 302.3, 332, 335, 11 R–11 TW

(56) References Cited

U.S. PATENT DOCUMENTS

| | | | | |
|---|---|---|---|---|
| 3,499,127 | * | 3/1970 | Cherry et al. | 200/17 |
| 3,590,176 | * | 6/1971 | Laserson et al. | 200/11 R |
| 3,809,833 | * | 5/1974 | Miller et al. | 200/61.27 |
| 4,200,773 | * | 4/1980 | Komatsu et al. | 200/11 R |
| 4,575,592 | * | 3/1986 | Rose | 200/6 R |
| 4,778,953 | * | 10/1988 | Kato | 200/11 G |

* cited by examiner

*Primary Examiner*—Michael Friedhofer
(74) *Attorney, Agent, or Firm*—Oblon, Spivak, McClelland, Maier & Neustadt, P.C.

(57) ABSTRACT

A waterproof lever switch, for use in various kinds of electric systems for an automobile engine, door, etc., includes: a waterproof ring made of synthetic rubber and attached in first and second circumferential grooves formed opposite each other in a disk part of a lever and a base, respectively, to form a watertight space between first and third approximately circularly-shaped recesses formed inside of both first and second circumferential grooves, an appropriate switch mechanism being mounted in the watertight space. The lever includes a lever part and the disk part and is rotatably mounted at a set angle on the base. The first circumferential groove is formed in an inner face of the disk part of the lever. The first approximately circularly-shaped recess is formed inside the first circumferential groove. A second approximately circularly-shaped recess is rotatably engaged at a set angle with the disk part of the lever and is formed in a surface of the base. A third approximately circularly-shaped recess is formed inside the second circumferential groove opposite the first approximately circularly-shaped recess of the lever. The disk part of the lever is engaged and mounted in the second approximately circularly-shaped recess of the base and a waterproof ring is inserted and mounted between the first circumferential groove of the lever and the second circumferential groove of the base opposite each other to form the watertight space between the first and third approximately circularly-shaped recesses. An appropriate switch mechanism includes a movable contact spring piece equipped with contacts and fixed contacts. The movable contact spring piece is mounted in the watertight space. By virtue of rotation, restoration of the disk part by rotation at the set angle, and restoration of the lever part of the lever projected outside the base, a circular-arc-shaped projection, projecting outwardly toward an inner face of the first approximately circularly-shaped recess of the lever, pushes and releases an actuating part of the switch mechanism to operate the switch.

20 Claims, 13 Drawing Sheets

WATERPROOF LEVER SWITCH

BACKGROUND OF THE INVENTION

1. Field of the Invention

The present invention generally relates to a waterproof lever switch, mainly for use in various kinds of electrical systems of automobiles, such as engines, doors, etc. and more particularly, to a waterproof lever switch including a waterproof ring, which is made of synthetic rubber and is attached in first and second circumferential grooves formed opposite each other in a base and in a disk part of a lever, respectively, the lever being rotatably mounted at a set angle on the base, to form a watertight space between first and third recesses formed inside of the first and second circumferential grooves, wherein an appropriate switch mechanism is mounted in the watertight space so that a switch of the switch mechanism is operated by rotation at the set angle and restoration of the lever.

2. Discussion of Background

It has been desired that a switch, for use in various kinds of electrical systems of an automobile, not only be miniaturized because of a confined space setting, but also have a high-precision waterproofness.

A switch of the above-described kind has been conventionally used, mainly the so-called micro-switch. However, there is a limitation in the miniaturization of a micro-switch and the micro-switch has a problem in that the smaller it becomes, the more expensive it is to manufacture. Another problem is that the entire body of the micro-switch should be covered with a waterproofing material in order to form a waterproof switch, thereby making it large-sized and more expensive. In such a case, a switch operation would need to be carried out indirectly from outside the waterproofing material. This would undesirably reduce the operability and precision, as compared with a non-waterproof micro-switch.

SUMMARY OF THE INVENTION

An object of the present invention is to solve the above-described conventional problems by providing an extremely simple and small-sized (i.e., each of length, width, and height is approximately 20 mm) waterproof switch.

The present invention solves the above-described conventional problems by providing a waterproof lever switch including: a first circumferential groove formed in an inner face of a disk part of a lever, wherein the lever includes a lever part and the disk part; a first approximately circularly-shaped recess is formed inside of the first circumferential groove; a second approximately circularly-shaped recess is rotatably engaged at a set angle with the disk part of the lever and is formed in a surface of a base; a second circumferential groove is formed at a position opposite the first circumferential groove of the lever; a third approximately circularly-shaped recess is formed inside of the second circumferential groove opposite the first approximately circularly-shaped recess; the disk part of the lever is engaged with the second approximately circularly-shaped recess of the base; a waterproof ring is inserted and mounted between the first circumferential groove A1 of the lever and the second circumferential groove of the base; a watertight space is formed between the first and third approximately circularly-shaped recesses which are located opposite each other; an appropriate switch mechanism is mounted in the watertight space; and a projection having a shape projecting outwardly toward an inner face of the first approximately circularly-shaped recess of the lever by virtue of rotation, restoration of the disk part by rotation at the set angle, and restoration of the lever part of the lever projected outside the base, pushes and releases an actuating part of the switch mechanism to operate the switch.

When the lever part of the lever, which projects outside of the base, rotates at a set angle, the projection, in the first approximately circularly-shaped recess, and disk part both rotate in synchronization with the rotation of the lever part. The projection then pushes and operates the actuating part of the switch mechanism mounted in the watertight space, thereby allowing the switch to perform operations, such as opening and closing of a circuit, switching of the circuit, and similar. Finally, when the lever part is rotated and restored to its original position, the switch is restored to the common state.

BRIEF DESCRIPTION OF THE DRAWINGS

A more complete understanding of the present invention may be had by reference to the following detailed explanations in connection with the accompanying drawings, in which.

DETAILED DESCRIPTION OF THE PREFERRED EMBODIMENTS

Figure 13:
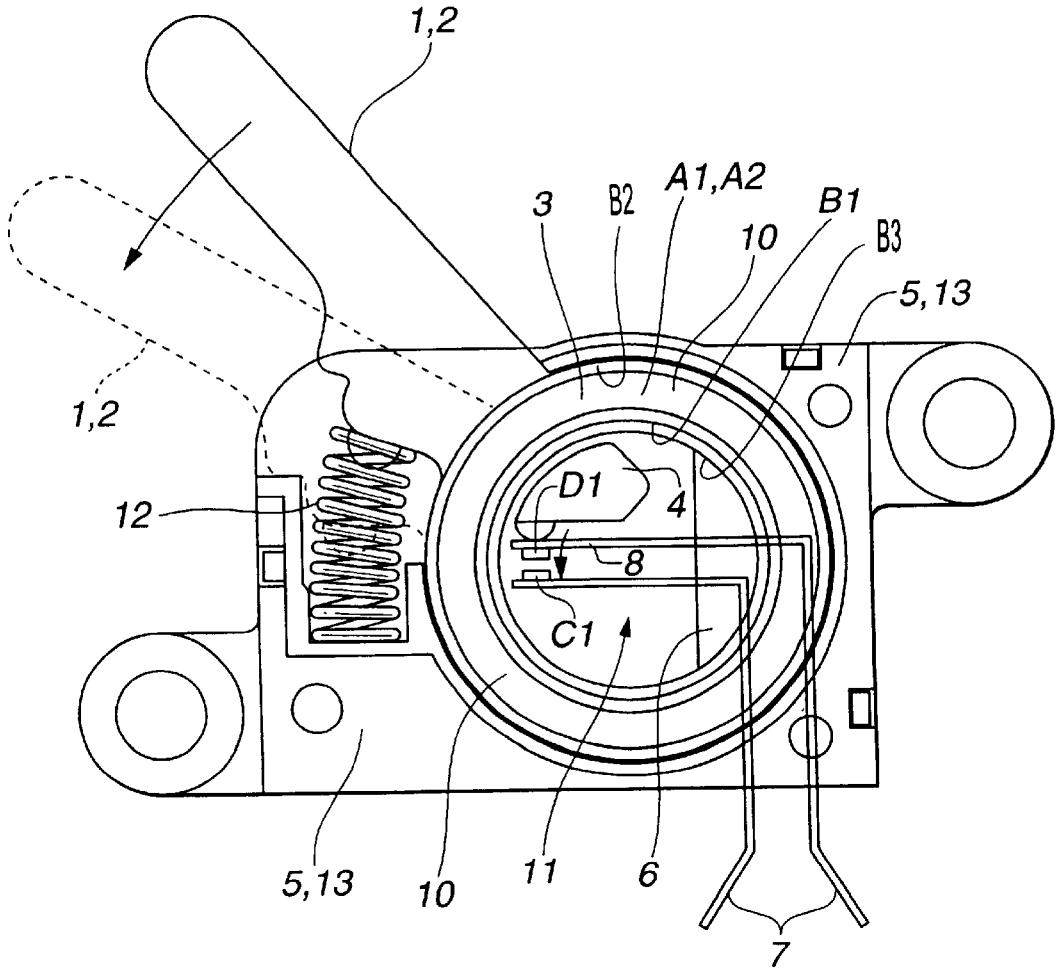
FIG. 13 is an elevational perspective view of a second embodiment.

Embodiments of the present invention are described in more detail with respect to the figures. In the second embodiment shown in FIG. 13, a leaf switch mechanism is mounted as a switch mechanism in a watertight space 11. A first circumferential groove A1 is formed in the watertight space 11 in an inner face of a disk part 3 of a lever 1. The lever 1 includes a lever part 2 and the disk part 3. A first approximately circularly-shaped recess B1 is formed inside of the first circumferential groove A1. A second approximately circularly-shaped recess B2 is rotatably engaged at a set angle with the disk part 3 of the lever 1 and is formed in a surface of a base 5. A second circumferential groove A2 is formed at a position opposite the first circumferential groove A1 of the lever 1. A third approximately circularly-shaped recess B3 is formed inside of the second circumferential groove A2 opposite to the first approximately circularly-shaped recess B1. The disk part 3 of the lever 1 is engaged with a second approximately circularly-shaped recess B2 of the base 5. A waterproof ring 10 is inserted and mounted between the first circumferential groove A1 of the lever 1 and the second circumferential groove A2 of the base 5, which oppose each other to form a watertight space 11 between both the first approximately circularly-shaped recess B1 of the lever 1 and the third approximately circularly-shaped recess B3 of the base 5. A leaf switch mechanism is mounted, as an example of an appropriate switch mechanism, in the watertight space 11. A projection 4 of the lever 1 rotates in synchronization with the rotation of the lever 1 caused by pushing the lever 1 at a set angle. The pushing of the lever 1 pushes and contra-flexes a movable contact spring piece 8, thereby making a contact D1 of the lever 1 come into contact with a fixed contact C1 so that the switch is turned ON. When the lever 1 is no longer being pushed and is released, the lever 1 and the projection 4 of the lever 1 arc restored to the original position by a restoring elastic force of a spring 12, thereby restoring the movable contact spring piece 8 to its original position and separating both contacts D1 and D2 so that the switch is turned OFF.

Figure 14:
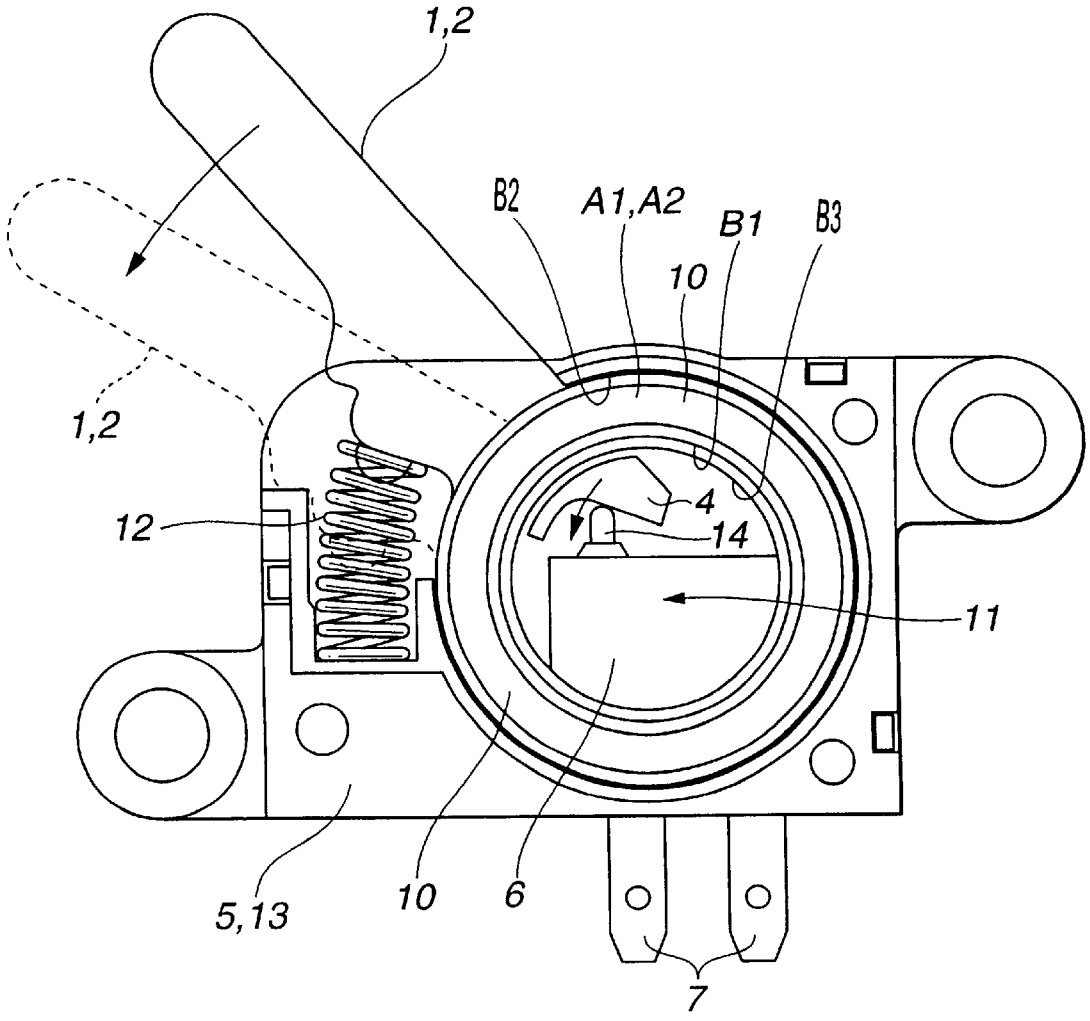
FIG. 14 is an elevational perspective view of a third embodiment.

In the embodiment shown in FIG. 14, a pin switch mechanism is mounted in the watertight space 11 as a switch mechanism. In the watertight space 11, the projection 4 of the lever 1 rotates in synchronization with the rotation caused by the pushing of the lever 1 at a set angle, which in turn pushes on the pin 14 to bring it down, thereby switching ON the switch mechanism. When the lever 1 is no longer being pushed and is released, the lever 1 and the projection 4 of the lever 1 are restored to the original position, thereby raising and restoring the pin 14 to switch OFF the switch mechanism .

Figure 15:
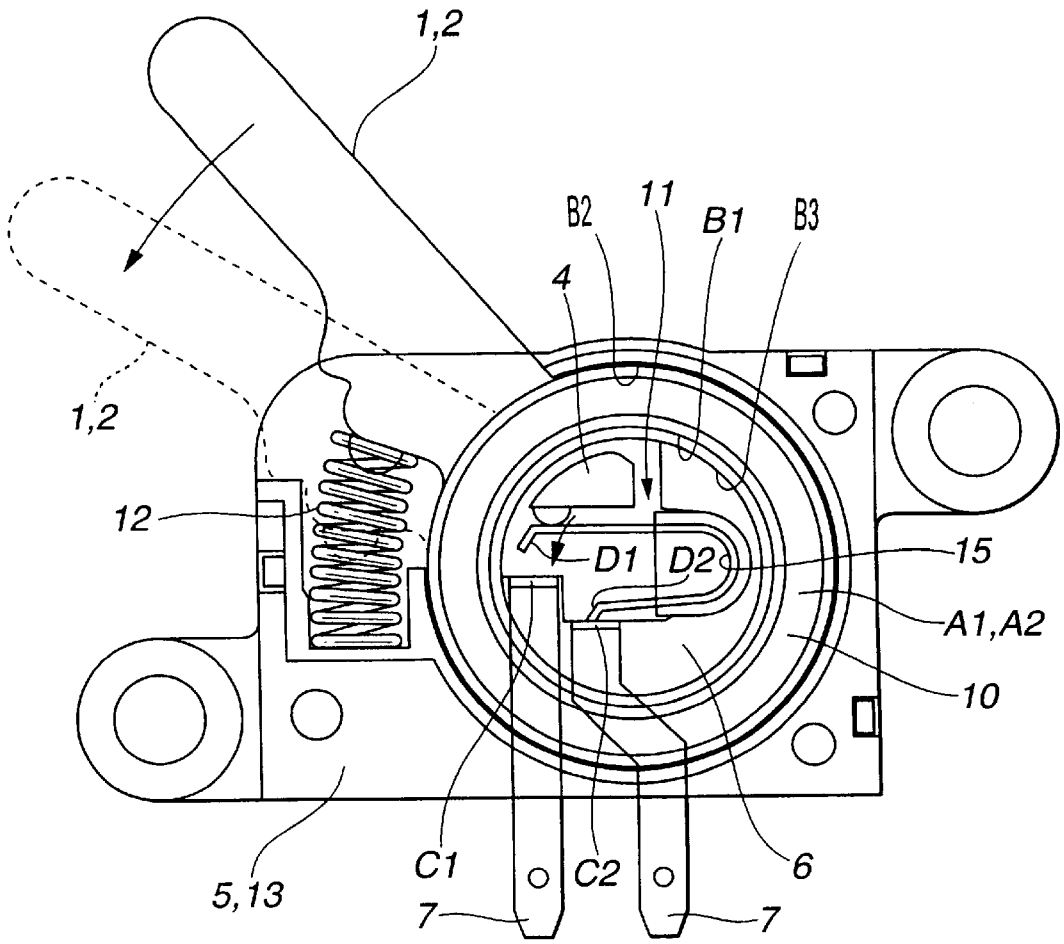
FIG. 15 is an elevational perspective view of a fourth embodiment.

In the embodiment shown in FIG. 15, a switch mechanism of a U-shaped contact spring piece 15 is mounted in the watertight space 11 as an appropriate switch mechanism. When the switch mechanism is at a common state, one contact D2 of the U-shaped contact spring piece 15 is in contact with one fixed contact C2, while the other contact D1 of the U-shaped contact spring piece 15 and the other fixed contact C1 stand opposite and apart from each other. The projection 4 of the lever 1 rotates in synchronization with the rotation caused by the pushing of the lever 1 at a set angle which pushes the U-shaped contact spring piece 15 to contra-flex it downwardly. This causes the contact D1 to contact the fixed contact C1 (i.e., turn the switch ON). When the lever 1 is released from being pushed, the lever 1 and the projection 4 of the lever 1 are restored to the original position, thereby restoring the U-shaped contact spring piece 15 and detaching the contact D1 from its contact with the fixed contact C1 (i.e., turning the switch OFF).

The embodiments shown in FIGS. 1–12 are provided with a switch mechanism in the watertight space 11. The switch mechanism includes an S-shaped movable contact spring piece 8 and a fixed contact C3 of a base 5.

The lever 1 includes a lever part 2 and a disk part 3. A first circumferential groove A1 is centered with respect to the center of the disk part 3. The first circumferential groove A1 is formed in an inner face of the disk part 3. A first approximately circularly-shaped recess B1 is formed inside of the inner side of the first circumferential groove A1. A circular-arc-shaped projection 4 has a set circular arc angle and is formed on the bottom face of the first approximately circularly-shaped recess B1 (see FIGS. 7 and 8).

The base 5 is provided with a second approximately circular-shaped recess B2, which is rotatably engaged with the disk part 3 of the lever 1 on the surface of the main body of the base 5, the main body having an approximately rectangular shape or similar. A second circumferential groove A2 is formed at a position opposite to the first circumferential groove A1, which is centered around the center of the second approximately circularly-shaped recess B2. A third approximately circularly-shaped recess B3 is formed inside of the inner side of the second circumferential groove A2 and a fixed contact C3 is exposed to the central part of the mounting part 6. A movable contact spring piece 8 is near the mounting part 6 on the transverse axis of the bottom of the third approximately circularly-shaped recess B3. The upper and lower positioned parts of the mounting part 6 are grooved much more deeply to form holes. Fixed contacts C1 and C2 are exposed and mounted on the bottom of each of the holes. The extensions of each fixed contact C1, C2, and C3 are projected as terminals 7 outside of the base 5 (see FIGS. 9 and 10).

The movable contact spring piece 8 is formed by mounting the contacts D1 and D2 to tops of each of upper portions 8*a* and lower portions 8*c* of the S-shaped movable contact spring piece 8. The S-shaped movable contact spring piece 8 includes an upper portion 8*a*, a middle portion 8*b*, and a lower portion 8*c* and forms angular projections 9*a* and 9*b* at the central parts of each upper portion 8*a* and lower portion 8*c*. The middle portion 8*b* is mounted on the mounting part 6 of the third approximately circularly-shaped recess B3 of the base 5 and keeps in contact with the fixed contact C3. This makes each contact D1 and D2 of the upper and lower portions 8*a* and 8*c*, respectively, and the fixed contacts C1 and C2 of the base 5, respectively, stand opposite to each other (see FIGS. 10, 11, and 12).

The disk part 3 of the lever 1 is rotatably engaged within the second approximately circularly-shaped recess B2 of the base 5. The waterproof ring 10 is inserted and mounted between the first circumferential groove A1 of the lever 1 and second the circumferential groove A2 of the base 5. The first and second circumferential grooves A1 and A2 oppose each other to form a watertight space 11 between the first approximately circularly-shaped recess B1 of the lever and the third approximately circularly-shaped recess B3 of the base 5. The upper end of the circular-arc-shaped projection 4, projected inside of the first approximately circularly-shaped recess B1 of the lever (inside the watertight space 11), strikes the angular projection 9*a* of the upper portion 8*a* of the movable contact spring piece 8 to be situated there. The top of the upper portion 8*a* is contra-flexed downwardly to push the contact D1 against the fixed contact C1 of the base 5 and to position the lower end of the circular-arc-shaped projection 4, which has been left short of the angular projection 9*b* of the lower portion 8*c* of the S-shaped movable contact spring piece 8. A spring 12 is biased and mounted between the lower face of the lever part 2 and the base 5 to force the lever 1 to rotate upwardly, while remaining centered around the center of the disk part 3. A cover 13 covers the surface of the lever 1. The top of the lever part 2 projects outwardly from the base 5 so as to rotate at a set angle to form a waterproof lever switch (see FIGS. 1–6).

Figure 1:
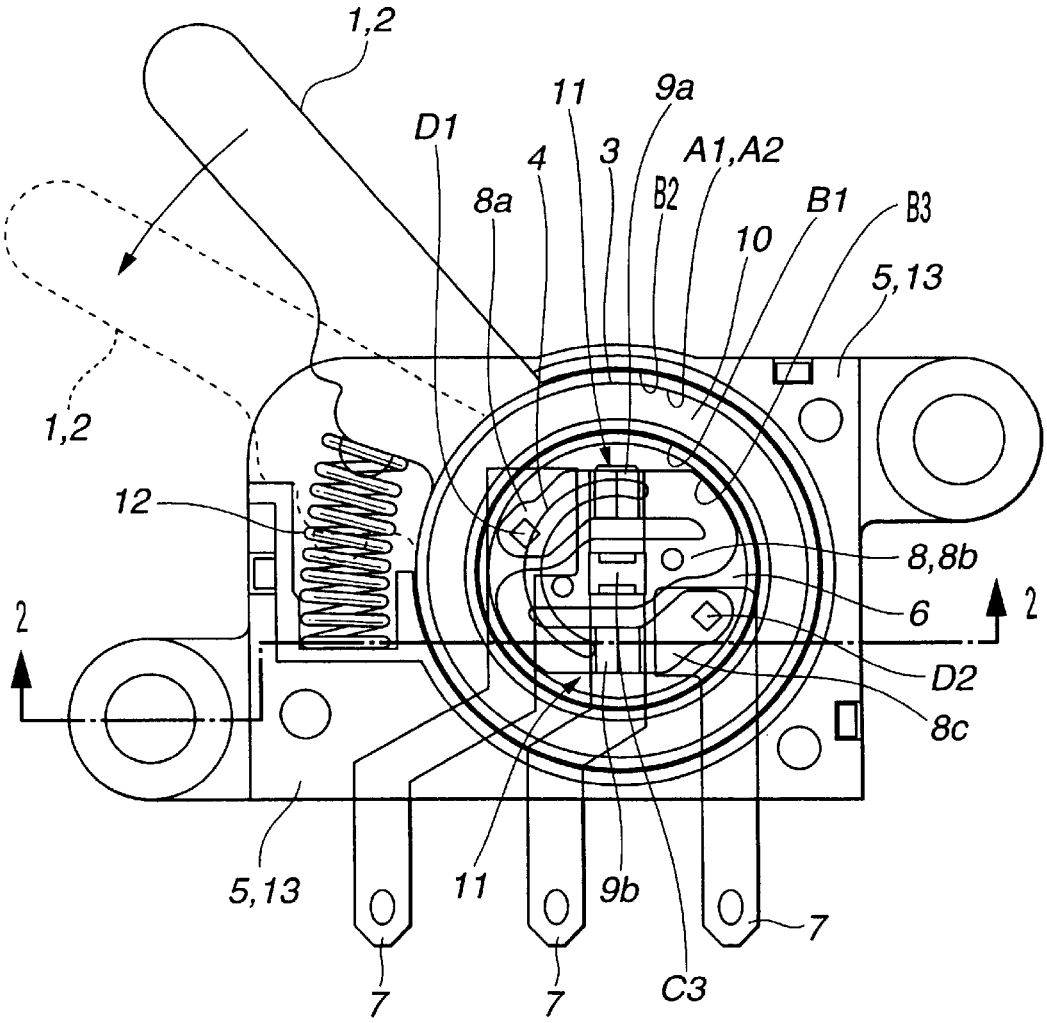
FIG. 1 is an elevational perspective view of a first embodiment of the present invention.
Figure 2:
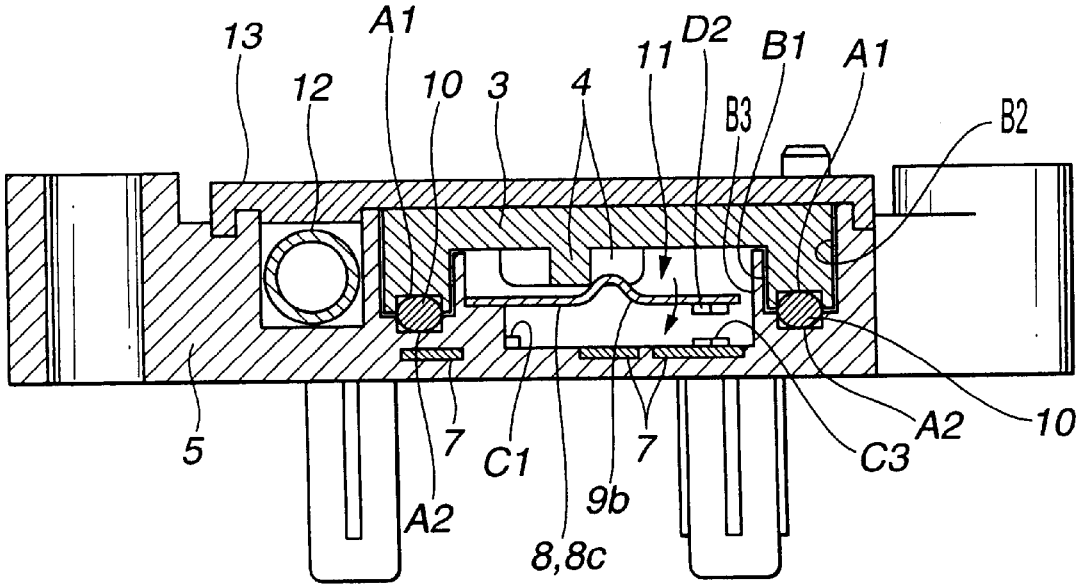
FIG. 2 is a cross-sectional view taken along the line 2—2 of FIG. 1.
Figure 3:
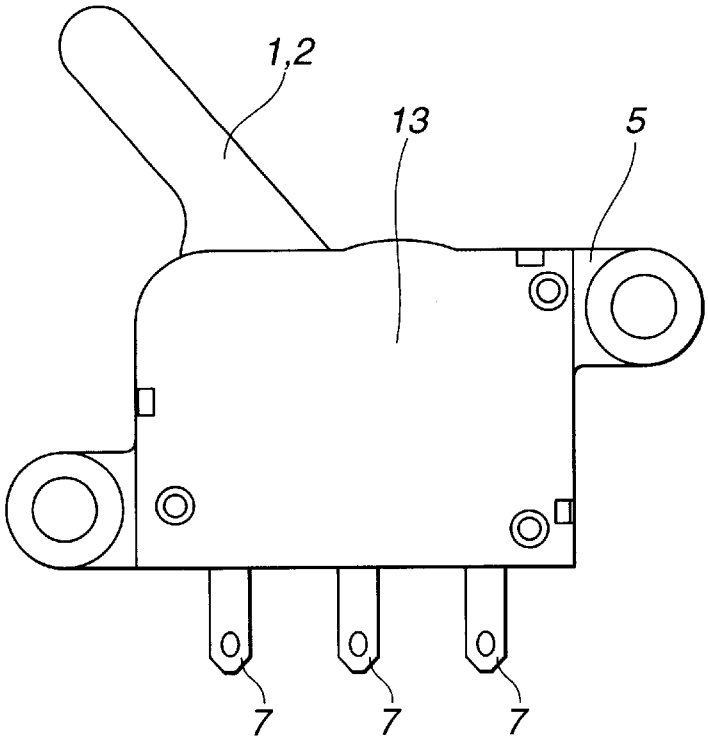
FIG. 3 is a front view of the first embodiment shown in FIG. 1.
Figure 4:
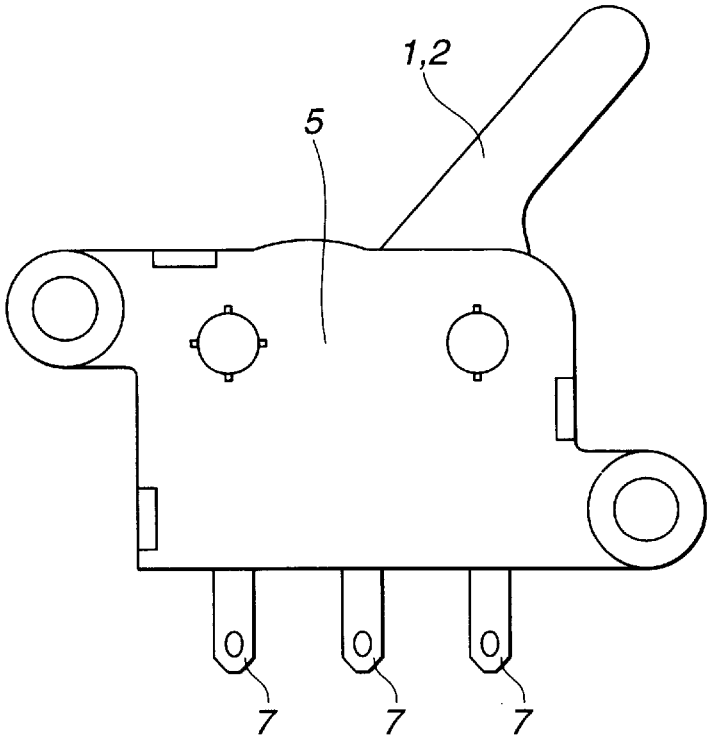
FIG. 4 is a rear elevational view of the first example shown in FIG. 1.
Figure 5A:
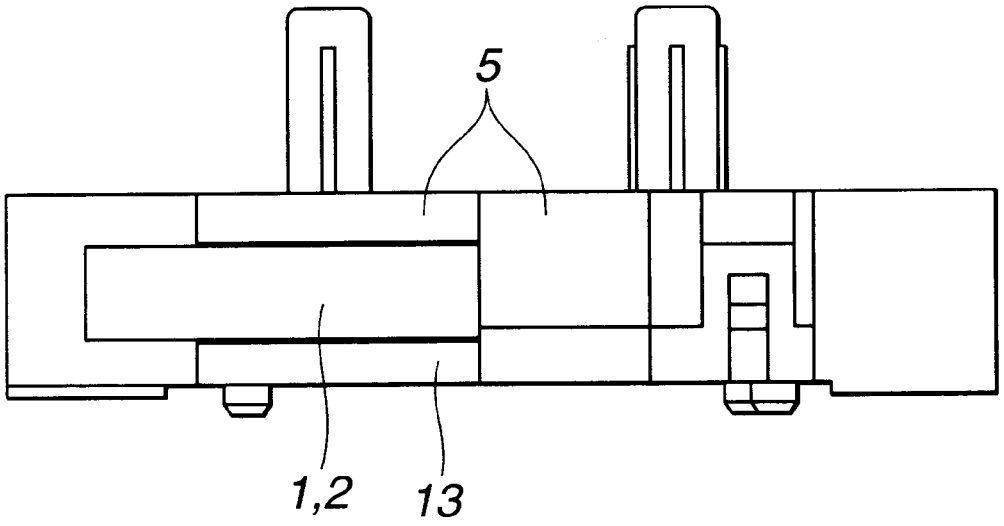
FIGS. 5(*a*) and 5(*b*) are a plan view and a bottom view, respectively, of the first embodiment shown in FIG. 1.
Figure 5B:
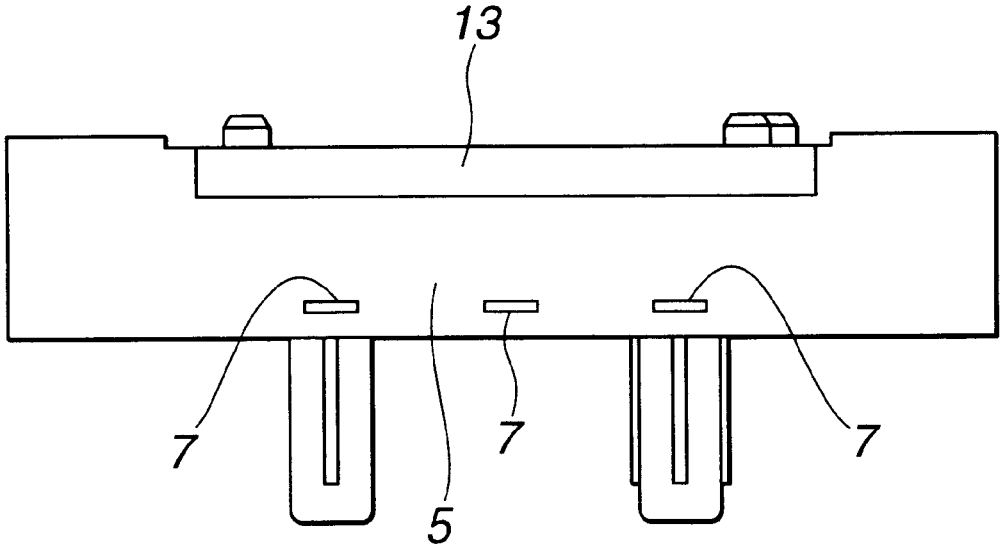
Figure 6A:
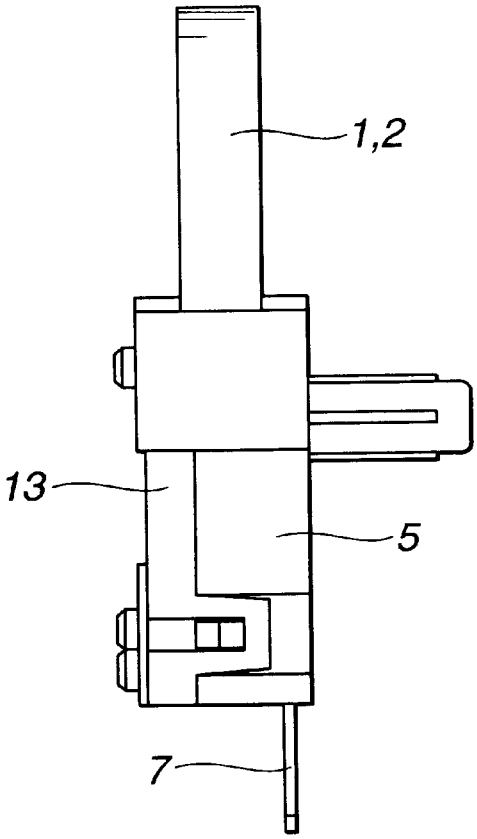
FIGS. 6(*a*) and 6(*b*) are a right side view and a left side view, respectively, of the first embodiment shown in FIG. 1.
Figure 6B:
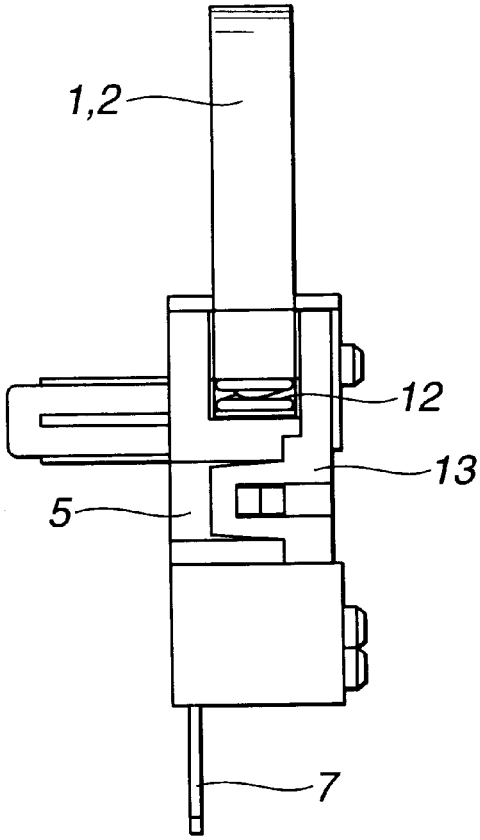
Figure 7A:
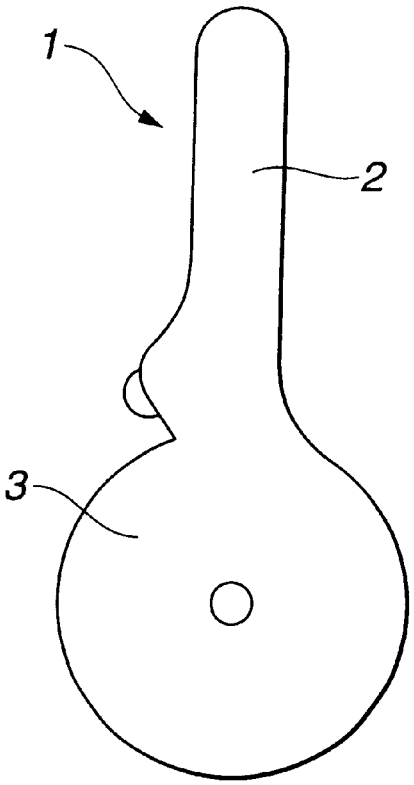
FIG. 7(*a*) and 7(*b*) are a front view and a left side view, respectively, of a lever of the first embodiment shown in FIG. 1.
Figure 7B:
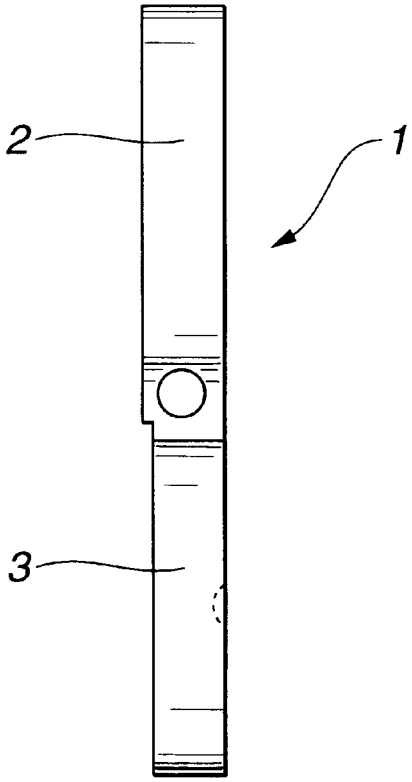
Figure 8A:
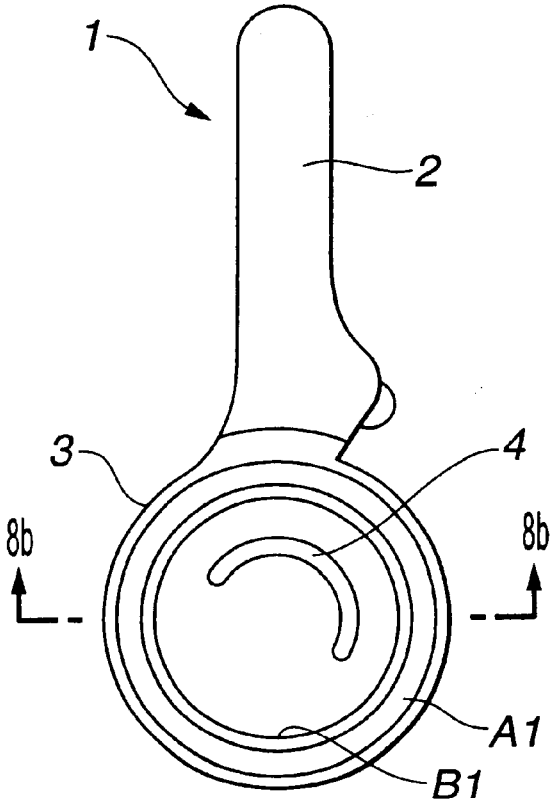
FIG. 8(*a*) is a rear (inner) view of FIGS. 7(*a*) and 7(*b*) and FIG. 8(*b*) is a cross-sectional view taken along the line 8*b*—8*b* of FIG. 8(*a*)
Figure 8B:
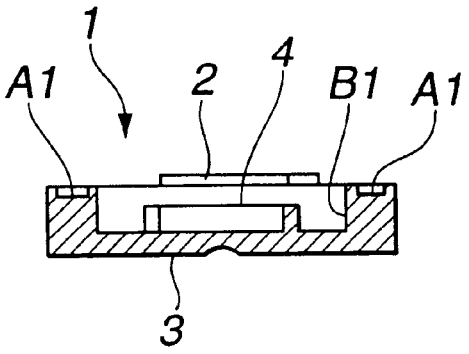
Figure 9A:
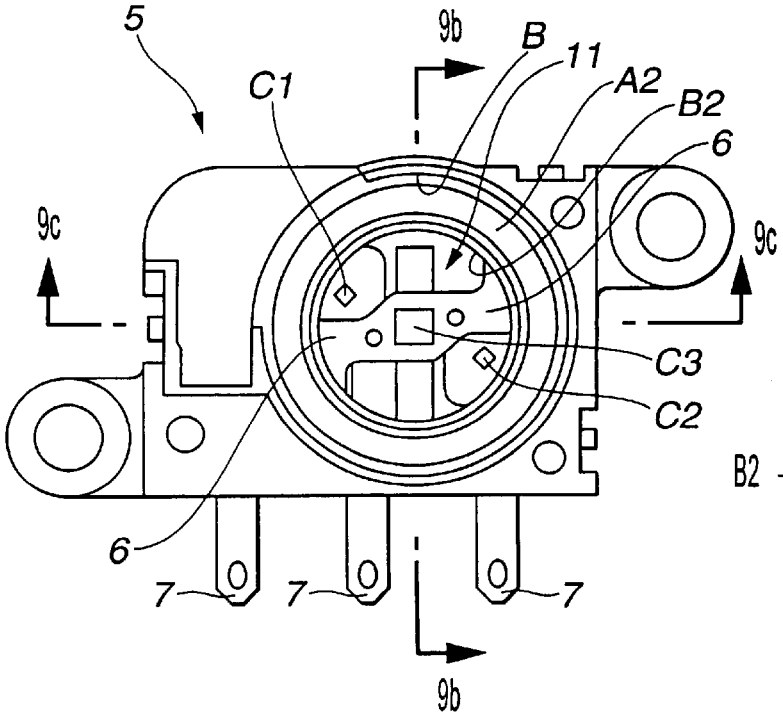
FIG. 9(*a*) is a front view of a base of the first embodiment shown in FIG. 1, FIG. 9(*b*) is a cross-sectional view taken along line 9*b*—9*b* of FIG. 9(*a*), and FIG. 9(*c*) is a cross-sectional view taken along line 9*c*—9*c* of FIG. 9(*a*)
Figure 9B:
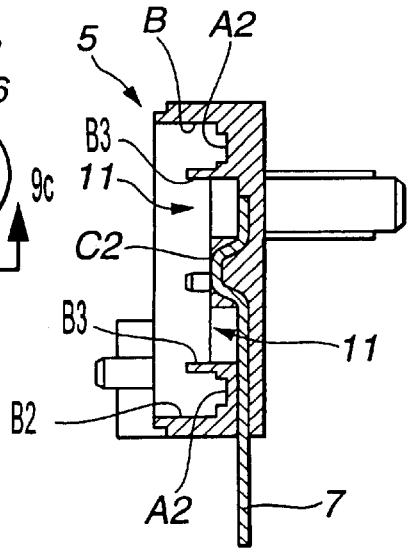
Figure 9C:
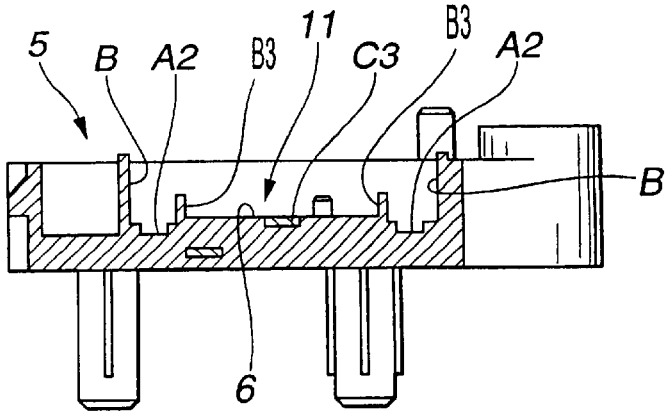
Figure 10:
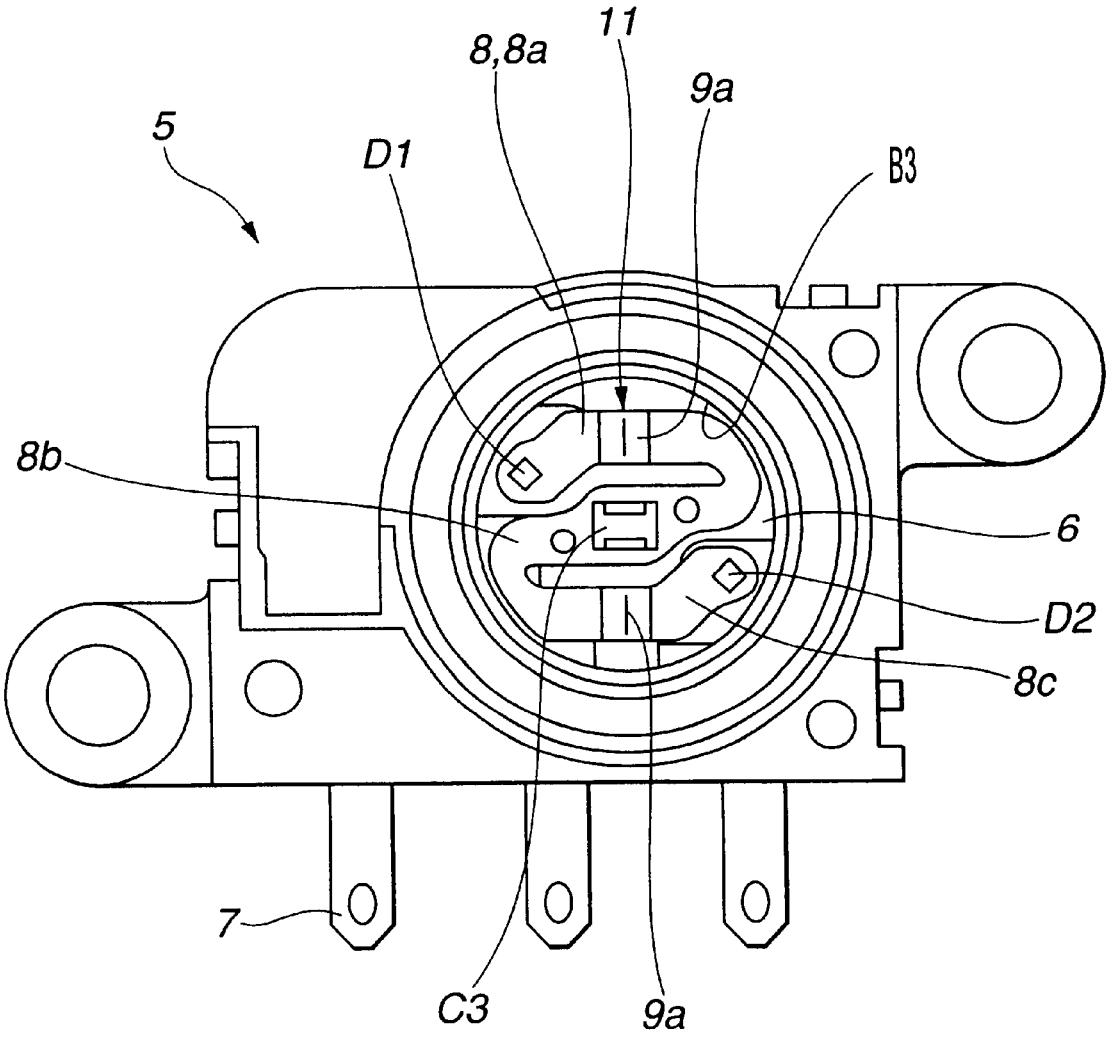
FIG. 10 is a schematic plan view showing a state wherein a movable contact spring piece is mounted on the base shown in the front view in FIG. 9(*a*)
Figure 11A:
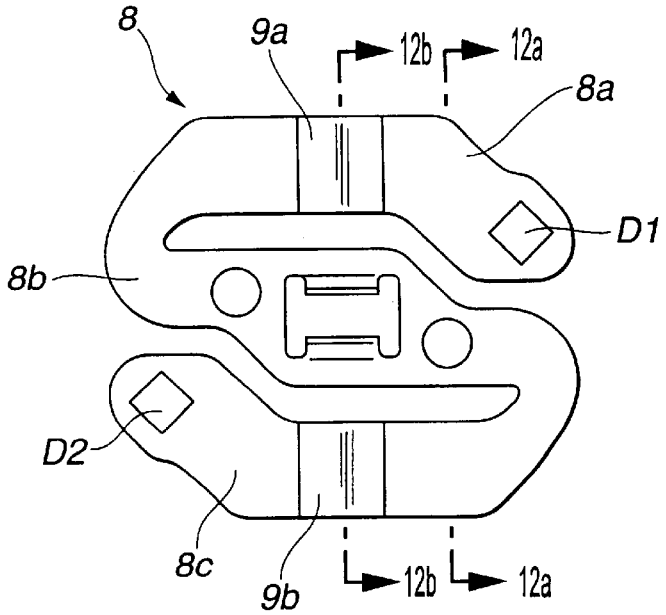
FIG. 11(*a*) is a rear elevational view of a movable contact spring piece of the first embodiment shown in FIG. 1 and FIG. 11(*b*) is a plan view of FIG. 11(*a*)
Figure 11B:
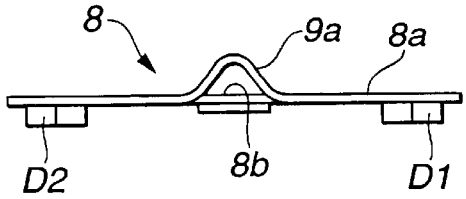
Figure 12A:
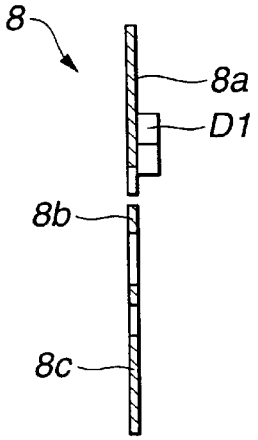
FIG. 12(*a*) is a cross-sectional view taken along the line 12*a*—12*a* of FIG. 11, and FIG. 12(*b*) is a cross-sectional view taken along the line 12*b*—12*b* of FIG. 11.
Figure 12B:
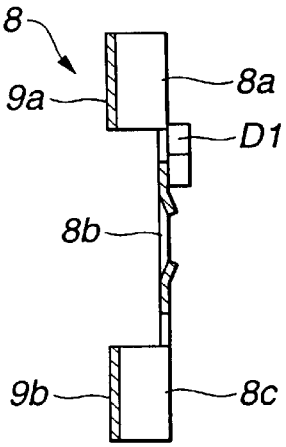

In operation, the embodiments, shown in FIGS. 1–12, will be described in more detail as follows. At common state, the middle portion 8*b* of the movable contact spring piece 8 comes into contact with the fixed contact C3 of the mounting part 6 (i.e., switch ON). The circular-arc-shaped projection 4 strikes the angular projection 9*a* of the upper portion 8*a* to push the contact D1 of the upper portion 8*a* into contact with the fixed contact C1 (i.e., switch ON), as shown in FIGS. 1 and 2.

Here, when the lever part 2 of the lever 1 is rotated downwardly at a set angle against the elastic force of the spring 12, the disk part 3 and its circular-arc-shaped projection 4 synchronously rotate. The upper end of the circular-arc-shaped projection 4 is detached from the angular projection 9*a* of the upper portion 8*a* of the movable contact spring piece 8. Then, the upper portion 8*a* is restored to its raised position so that the contact D1 is removed from contact with the fixed contact C1 (i.e., switch OFF). Simultaneously, the lower end of the circular-arc-shaped projection 4 strikes the angular projection 9*b* of the lower portion 8*c*. Thus, the lower portion 8C is contra-flexed downwardly and the contact D2 pushes against the fixed contact C2 to make them come into contact with each other (i.e., switch ON). That is to say, a circuit is switched.

Next, when the lever 1 is released from being pushed, the lever 1 and its circular-arc-shaped projection 4 are restored and rotate by virtue of the restoring elastic force of the spring 12. The lower end of the circular-arc-shaped projection 4 is detached from the angular projection 9*b* of the lower portion 8*c*, and the contact C2 is detached from the fixed contact D2 (i.e., switch ON). Simultaneously, the upper end of the circular-arc-shaped projection 4 strikes the angular projection 9*a* of the upper portion 8*a* to make the contact C1 come into contact with the fixed contact D1 (i.e., switch ON), thereby restoring the common state.

According to the present invention, since the waterproof ring is inserted and mounted between both of the first and second circumferential grooves formed in the base and the disk part of the lever, respectively, not only the rotating part in both of the first and second circumferential grooves can be constructed so as to be watertight, but also the space formed by both of the first and third approximately circularly-shaped recesses inside of both of the first and second circumferential grooves can be formed so as to be watertight, thereby exhibiting excellent characteristics for maintaining the waterproofness of the switch mechanism mounted in the space with high-precision.

According to the present invention, since the part, corresponding to an axis of rotation of the lever, is formed in the disk part having a large diameter, the entire switch can be constructed extremely simply, while ensuring highly-precise waterproofness, thereby enabling miniaturization and sophistication of the waterproof switch.

Since the present invention can be provided with any switch mechanisms to be mounted in the watertight space other that those illustrated herein, the present invention has the merit of versatility and can be used as a switch for various purposes.

What is claimed is:

1. A waterproof lever switch comprising:

a first circumferential groove formed in an inner face of a disk part of a lever, said lever including a lever part and said disk part;

a first approximately circularly-shaped recess having a circular shape and the like formed inside said first circumferential groove;

a second approximately circularly-shaped recess formed in a surface of a base and rotatably engaged at a set angle with said disk part of said lever;

a second circumferential groove formed in said base at a position opposite said circumferential groove of said lever;

a third approximately circularly-shaped recess formed inside said second circumferential groove opposite said first circular-shaped recess of said lever;

said disk part of said lever is engaged and mounted in said second approximately circularly-shaped recess of said base;

a waterproof ring inserted and mounted between said first circumferential groove of said lever and said second circumferential groove of said base a watertight space formed between said first approximately circularly-shaped recess and said third approximately circularly-shaped recess;

an appropriate switch mechanism mounted in said watertight space; and a projection, which projects outwardly toward an inner face of said first approximately circularly-shaped recess and which, by virtue of rotation, restoration of said disk part by rotation at said set angles and restoration of said lever part of said lever projected outside said base, pushes and releases an actuating part of said switch mechanism to operate said waterproof lever switch.

2. The waterproof lever switch of claim 1, wherein said first circumferential groove, formed in said inner face of said disk part, is centered around a center of said disk part.

3. The waterproof lever switch of claim 2, wherein said first approximately circularly-shaped recess is formed inside of a middle portion of said first circumferential groove.

4. The waterproof lever switch of claim 3, wherein said projection is a circular-arc-shaped projection having a set circular arc angle and being projected out from a bottom face of said first approximately circularly-shaped recess.

5. The waterproof lever switch of claim 4, wherein said base is provided with said second approximately circularly-shaped recess rotatably engaging said disk part of said lever on a surface of a main body of said base, said main body having a rectangular shape.

6. The waterproof lever switch of claim 5, wherein said third approximately circular-shaped recess is centered with respect to a center of said second approximately circularly-shaped recess and is formed inside a middle portion of said second circumferential groove.

7. The waterproof lever switch of claim 6, further comprising a first fixed contact exposed to a central part of a mounting part of a movable contact spring piece which is near a transverse axis of a bottom face of said third approximately circularly-shaped recess.

8. The waterproof lever switch of claim 7, wherein an upper-positioned part and a lower-positioned part of said mounting part are grooved more deeply to form holes.

9. The waterproof lever switch of claim 8, further comprising second and third fixed contacts which are mounted to each bottom of said holes of said upper-positioned part and said lower-positioned parts of said mounting part.

10. The waterproof lever switch of claim 9, further comprising extensions of each of said first, second, and third fixed contacts, wherein said extensions are projected outside of said base as terminals.

11. The waterproof lever switch of claim 10, wherein said movable contact spring piece is provided with a first contact and a second contact on tops of an upper portion and a lower portion of a S-shaped spring piece which in addition to said upper and lower portions, has a middle portion.

12. The waterproof lever switch of claim 11, further comprising angular projections formed on said middle portion of said S-shaped spring piece.

13. The waterproof lever switch of claim 12, wherein said middle portion is mounted on said mounting part of said third approximately circularly-shaped recess of said base and keeps in contact with said first fixed contact.

14. The waterproof lever switch of claim 13, wherein each of said first and second contacts of said upper and lower portions and said second and third fixed contacts of said base are made to stand opposite each other.

15. The waterproof lever switch of claim 14, wherein said disk part of said lever is engaged and rotatably mounted in said second approximately circularly-shaped recess of said base.

16. The waterproof lever switch of claim 15, wherein an upper end of said circular-arc-shaped projection, which projects outwardly toward an inside of said first approximately circularly-shaped recess of said lever, is made to strike said angular projection of said upper portion of said movable contact spring piece.

17. The waterproof lever switch of claim 16, wherein a top of said upper portion is contraflexed downwardly to push said first contact toward said second fixed contact of said base.

18. The waterproof lever switch of claim 17, wherein said lower portion of said circular-arc-shaped projection is positioned at a position so as to be left slightly short of said angular projection of said lower portion.

19. The waterproof lever switch of claim 18, further comprising a spring biased between a lower face of said lever and said base to force said lever to rotate upwardly, centered around said center of said disk part.

20. The waterproof lever switch of claim 19, further comprising a cover to cover a surface of said base and said lever, wherein a top of said lever part is projected outside of said base rotatably at said set angle.

* * * * *